US005572878A

United States Patent [19]

Kapoor

[11] Patent Number: 5,572,878

[45] Date of Patent: Nov. 12, 1996

[54] AIR CONDITIONING APPARATUS AND METHOD OF OPERATION

[75] Inventor: Surendra Kapoor, North Olmsted, Ohio

[73] Assignee: York International Corporation, York, Pa.

[21] Appl. No.: 332,821

[22] Filed: Oct. 31, 1994

[51] Int. Cl.[6] ..... F25B 1/10

[52] U.S. Cl. ..... 62/175; 62/158; 62/193; 236/1 EA

[58] Field of Search ..... 62/175, 157, 158, 62/231, 510, 228.3, 126, 127, 129, 176.6, 176.1, 192, 193; 236/1 EA

[56] References Cited

U.S. PATENT DOCUMENTS

| | | | |
|---|---|---|---|
| 2,978,228 | 4/1961 | Carlson | 236/1 EA X |
| 4,257,238 | 3/1981 | Kountz et al. | 62/176.6 X |
| 4,356,961 | 11/1982 | Smith | 62/175 X |
| 4,757,694 | 7/1988 | Espinosa | 62/158 X |
| 4,819,441 | 4/1989 | Hanson | 62/158 X |
| 5,062,276 | 11/1991 | Dudley | 62/176.6 |
| 5,170,636 | 12/1992 | Hitosugi | 236/1 EA X |
| 5,231,846 | 8/1993 | Goshaw et al. | 62/510 X |

*Primary Examiner*—Harry B. Tanner
*Attorney, Agent, or Firm*—Finnegan, Henderson, Farabow, Garrett and Dunner, L.L.P.

[57] ABSTRACT

Two compressors are connected in tandem for an air conditioning system. A control board that includes a microcontroller controls the operation of the system in response to the energization of first and second stage terminals of a thermostat. The system includes anti-short cycling and eliminating operation of crankcase heaters during a time period following the shutting off of the compressors.

17 Claims, 6 Drawing Sheets

AIR CONDITIONING APPARATUS AND METHOD OF OPERATION

BACKGROUND OF THE INVENTION

1. Field of the Invention

The present invention relates to air conditioning apparatus and method of operation.

Although the present invention is suitable for single compressor air conditioning systems having one or more stages, it is particularly advantageous for systems using tandem compressors and will be described in connection therewith. The term "air conditioning", when used herein is meant to include both the heating as well as the cooling of air in communication with an indoor coil of the heating/cooling system.

2. Description of Related Art

An air conditioning or heating system typically includes either a single or a multi-stage compressor. The capacity of a system using a multi-stage compressor is increased by increasing the compressor speed. Such compressors are generally equipped with a crankcase heater which turns "off" when the compressor turns "on" and turns "on" when the compressor turns "off."

In conventional systems using single speed compressors, the crankcase heater is "on" when the compressor is "off."

In many conventional systems using two-speed compressors, it is common to turn on the crankcase heater only when the ambient temperature is below 75° F. One of the possible drawbacks to this kind of a system is that the outdoor ambient temperature may be above 75° F. and the compressor may be off. If the crankcase heater system is not running, the refrigerant may be in a liquid state at that point of time and the two-speed compressor may be required to start up full of liquid and slugging. Since compressors are designed to handle gas only, such slugging is detrimental to the life of the compressor.

Conventional systems are subject to short cycling; that is, the compressor starts and stops frequently in response to the operation of a thermostat in order to maintain a fairly constant comfortable temperature. The short cycling of a compressor shortens its life considerably, and prevents adequate removal of moisture from the air. In addition short cycling of the compressor causes the turning on and off of the crankcase heater between cycles at frequent intervals, thus using an inordinate amount of power.

In a system with a single stage compressor, the indoor air handler may deliver the air flow at a variable rate depending on the difference between the outdoor and indoor temperature. In a multi-stage system, the air flow may be increased when the thermostat calls for an increased speed of the compressor. This, particularly in combination with a short cycle time, reduces the capability of a single stage or two stage system to remove moisture from the air being conditioned.

In light of the foregoing, there is a need for an air conditioning system and method that significantly reduces operating costs, provides superior home comfort, a higher SEER efficiency, and a longer trouble-free life.

SUMMARY OF THE INVENTION

Accordingly, the present invention is directed to an air conditioning apparatus and method of operation that substantially obviates one or more of the problems due to limitations and disadvantages of the related art.

To achieve these and other advantages, and in accordance with the purpose of the invention, as embodied and broadly described, the invention is an air conditioning apparatus that includes first and second motor operated compressors having a common suction line and a common indoor coil. The apparatus includes a control board having a first stage and a second stage thermostat input which are energized in response to the closing of a respective first and second contact of a thermostat, and having first and second compressor output terminals that are energized selectively to operate the respective first and second compressors; means responsive to the energization of the first stage thermostat input for energizing the first compressor output terminal, means responsive to the energization and deenergization of the second stage thermostat input for respectively energizing and de-energizing the second compressor output terminal at times when the first compressor output terminal is energized; and means responsive to the deenergization of the first stage thermostat input at times when the second stage output terminal is energized for deactivating both the first and second compressor output terminals.

In another aspect, the present invention is a method of operating an air conditioning apparatus that includes first and second motor operated compressors having a common suction line and a common indoor coil, a control board having a first stage and a second stage thermostat input, and a first and second compressor output terminals that are energized selectively to operate the first and second compressors, said method comprising energizing the first compressor output terminal in response to the energizing of the first stage thermostat input, and energizing the second compressor output terminal at times when the first thermostat input is energized in response to the energizing of the second stage thermostat input, and de-energizing the first and second compressor output terminals in response to the de-energizing of the first stage thermostat input.

In another aspect, the invention is an air conditioning apparatus that includes at least one motor operated compressor having a crankcase heater, and adapted to be located exterior of the area to be conditioned and an indoor coil adapted to be located in communication with the area to be conditioned, a control board having a thermostat input energized in response to the closing of a contact of a thermostat, a compressor output terminal for applying a signal to activate the at least one compressor, means responsive to the energizing of the thermostat input for applying a signal to the compressor output terminal for activating the at least one compressor, means responsive to a signal being applied to the compressor output terminal for de-energizing the crankcase heater; and means for energizing the crankcase heater at the expiration of a five to sixty minute time period following the cessation of the signal to the compressor output terminal at times when the thermostat input is deenergized at said time period expiration.

In still another aspect, the invention is a method of operating an air conditioning apparatus having at least one motor operated compressor, a crankcase heater, a control board having a thermostat input and a compressor output terminal for energizing and de-energizing the at least one compressor; the method comprising de-energizing the crankcase heater at times when the compressor output terminal is energized; and energizing the crankcase heater at the expiration of a time period ranging from five to sixty minutes following the deenergization of the compressor output terminal at times when the thermostat input is continually deenergized for a greater time than said time period.

Additional features and advantages of the invention will be set forth in the description which follows, and in part will be apparent from the description, or may be learned by practice of the invention. The objectives and other advantages of the invention will be realized and attained by the apparatus, and method particularly pointed out in the written description and claims hereof as well as the appended drawings.

It is to be understood that both the foregoing general description and the following detailed description are exemplary and explanatory and are intended to provide further explanation of the invention as claimed.

The accompanying drawings which are included to provide a further understanding of the invention are incorporated in and constitute a part of this specification, illustrate one embodiment of the invention and together with the description serve to explain the principles of the invention.

DESCRIPTION OF THE PREFERRED EMBODIMENT

Figure 1:
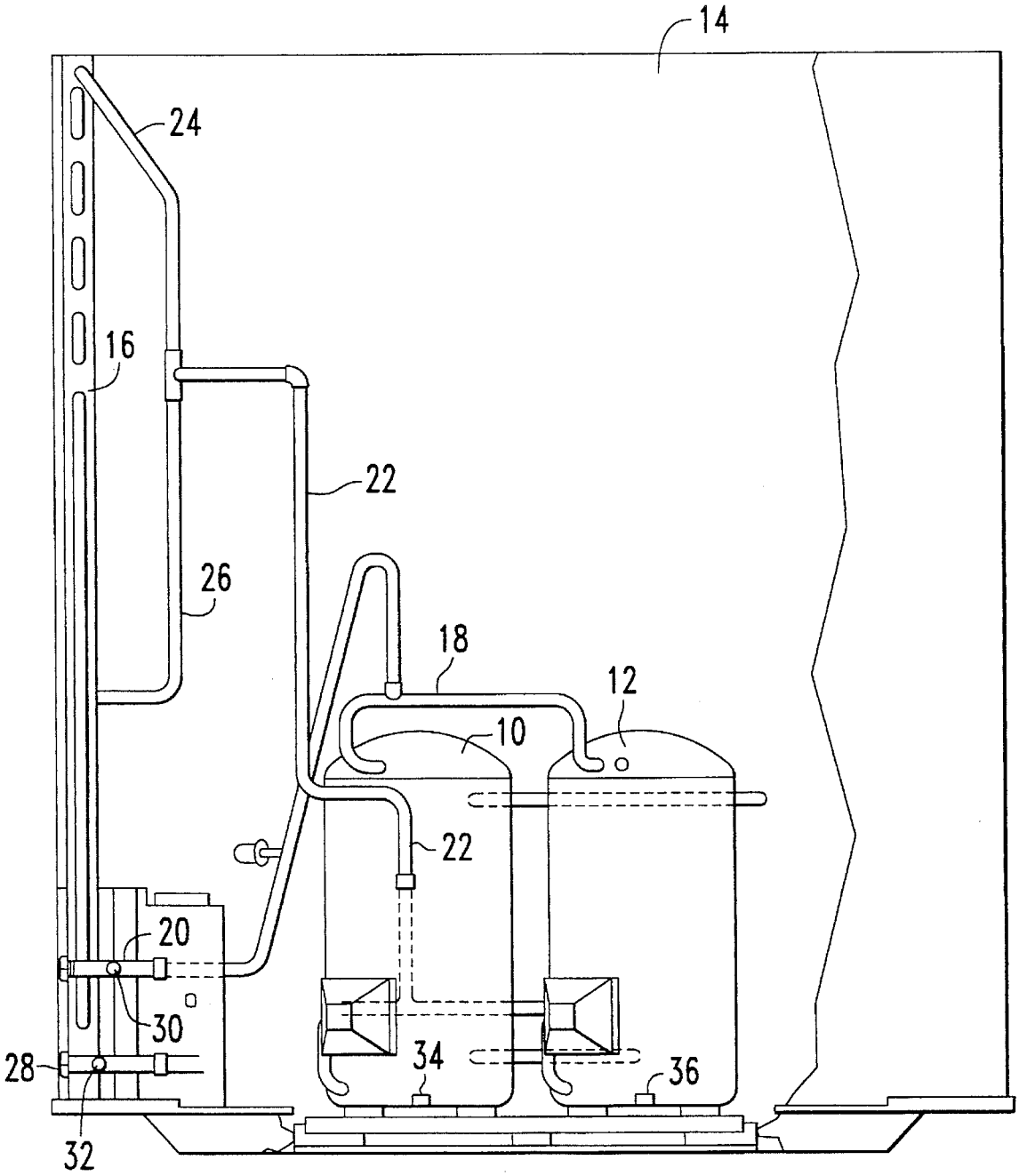
FIG. 1 is a view in elevation of an air conditioning apparatus with a wall broken away to show a first and second compressor connection in tandem in accordance with the present invention.

Reference is now made to a specific embodiment of the present invention wherein like parts to the extent possible bear similar reference characters.

The apparatus of the present invention comprises a first compressor and a second compressor having a common suction line, a common indoor coil, and a common discharge line to a condenser. As shown in FIG. 1, a first compressor 10 and a second compressor 12 are mounted in a housing 14 having a wall-mounted condenser 16. The compressors 10 and 12 each have a suction side that is commonly connected by piping 18 which extends via piping 19 to a valve 20. The compressors 10 and 12 are also commonly connected to a discharge line 22 that branches into the condenser 16 via piping 24 and 26. The condensate from the condenser 16 flows into valve 28. The valves 20 and 28 are connected to an indoor coil (not shown) that terminates at one end at outlet 30, and the compressors 10 and 12 each have a crankcase heater referenced at 34 and 36.

The apparatus of the present invention also includes a variable speed motor-operated fan that is positioned relative to the indoor coil, and when activated to a first condition is operative to pass a volume of air past the coil at a first rate and operative when activated to a second condition to pass a volume of air past the coil at a second rate.

Figure 2:
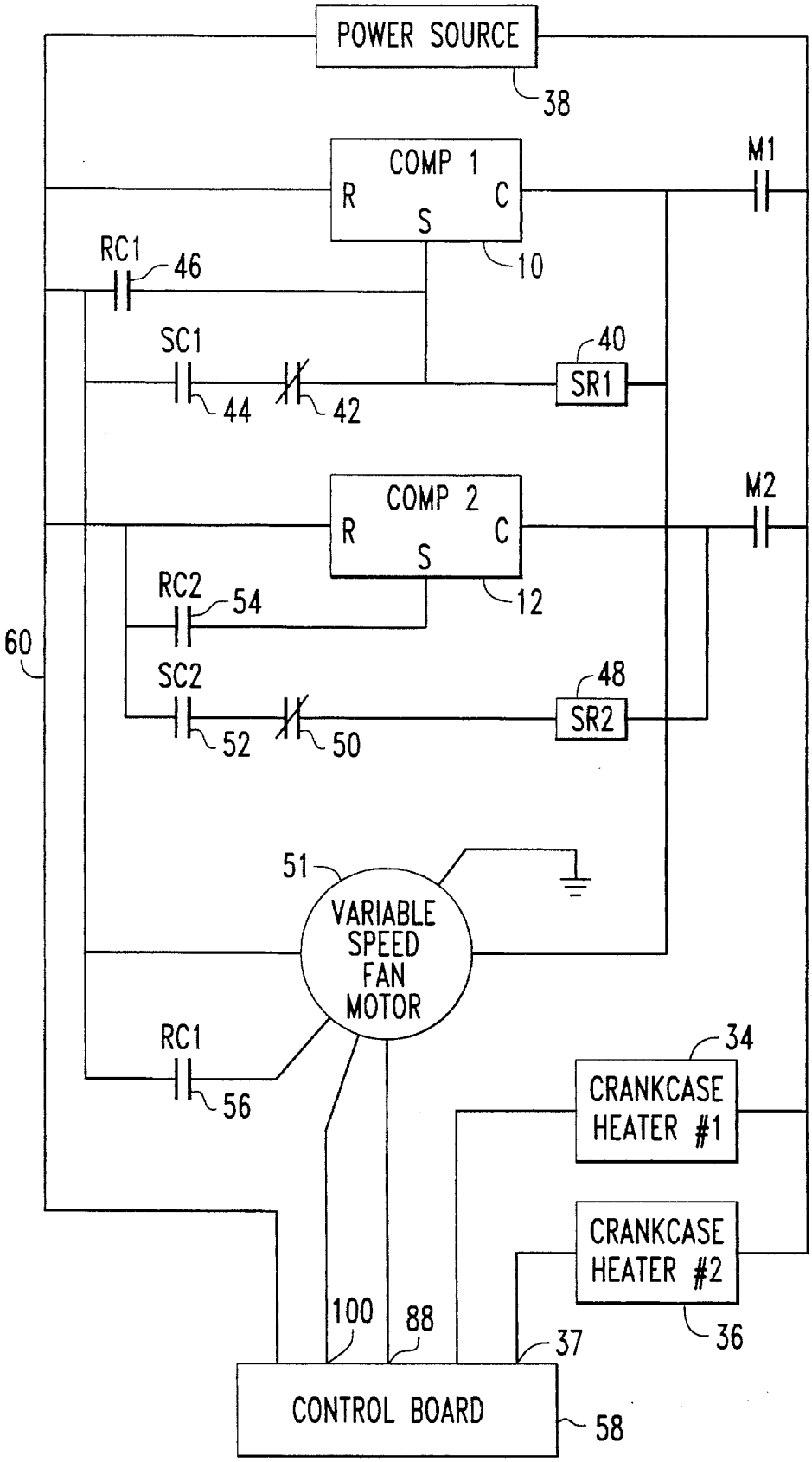
FIG. 2 is a schematic diagram of the electrical connection of the first and second compressors of FIG. 1.

As shown in FIG. 2, the first compressor 10 and the second compressor 12 are electrically connected to a power source 38, which is preferably an AC source having a voltage in the 208- to 230-volt range. The compressor 10 is operated by connected to the power supply through a contact M1 which is normally open and is closed to energize the compressor by energizing a start relay 40. The start relay 40 is energized through a normally closed contact 42 of a lockout relay, hereinafter shown in FIG. 3, and a start capacitor 44. A running capacitor 46 is connected to the power supply 38. The second compressor 12 is connected to the power supply 38 through a normally open contact M2 of a start relay 48. The relay 48 is energized by a circuit that extends from the common connection through a normally closed lockout relay contact 50, and a start capacitor 52. A running capacitor 54 is connected between the power supply 38 and the terminal S of the compressor 12. A variable speed fan motor for the indoor fan, as previously described, is energized by a circuit that extends from a common connection of the first compressor 10 through the fan motor and to the terminal R of the compressor 10. A running capacitor for the variable speed indoor fan motor 51 is referred to at 56. The crankcase heaters 34 and 36 are connected in parallel to the power supply 38 and through a control board 58 to the power supply 38 over line 60. Thus, the first compressor 10 is operated by energizing the start relay 40 which closes the contact M1, and the compressor 12 is operated by energizing the start relay 48 which closes the contact M2. The terminal R of the compressors 10 and 12 is connected to a secondary transformer line of the variable speed fan motor, and the terminal C of the compressors is connected to a common terminal. The terminal S is a control terminal.

The apparatus of the present invention includes a control board 58 having a microcontroller that is preferably of the type manufactured by Texas Instrument Co. and known as Model 6AC-1, revision 3. The control board is connected to control the compressors 10 and 12, the crankcase heaters 34 and 36, and the indoor variable speed for motor 51.

As shown in FIG. 2 the control board has mounted on its surface, a lockout relay 62 for the first compressor 10 and a lockout relay 64 for the second compressor 12. The relays 62 and 64 are driven by a relay driver 66 that in turn is operated by the microcontroller 61 as hereinafter described.

The control board of the present invention has mounted a normally open crankcase heater delay relay 70 that closes its contact (not shown) to energize the crankcase heaters 34 and 36. A light emitting diode (LED) 72 is mounted on the board for indicating the operational state of the system. The LED is steadily lit during normal operation, and indicates a five minute warming up period of the control board 58 prior to any operation of the components by flashing the LED for five minutes, (½ second on and four seconds off). When a pressure limit switch opens, the LED flashes on and off at one second intervals, and when there is a lockout, the LED flashes on and off rapidly. The control board is energized by a low voltage source connected to terminals 74 and 76 which is connected to a 24 voltage source from the secondary winding of a transformer in the indoor air handler. A first compressor output terminal 96, in response to an energy signal supplied by the microcontroller 61, operates the first compressor 10. A second compressor output terminal 98 in response to an energizing signal supplied by the microcontroller 61 operates the second compressor 12.

The control board of the present invention also includes a plurality of input terminals connected to the microcontroller 61. A first stage thermostat input terminal which is connected externally to the first stage contact of a thermostat, is referred to at 78 and the second stage thermostat input terminal which is connected externally to the second stage contact of a thermostat is referred to at 80. The first and second stage thermostat inputs are coupled to the microcontroller 61.

High and low pressure limit switch indication terminals, which are referred to at 82, 84, and 86, are connected to normally closed series connected limit switches as shown by line 83 that open in response to an excessive high pressure or an insufficient low pressure, and are also coupled to the microcontroller 61.

A terminal 88 is connected to the second compressor output terminal 98 and the variable speed indoor fan motor 51 for operating the fan at a speed selected by the second compressor output terminal. The terminals 92 and 94 are connected to the transformer line and the common connection, respectively, for supplying the low voltage to operate the control board components. A test terminal 89 is connected to the microcontroller 61 for running the system in a TEST mode. In the TEST mode all time delays are reduced to one second.

The apparatus of the present invention is operative to respond to the initial application of low voltage power to the control board by rendering the first and second compressor output terminal unresponsive to the energizing of the first and second stage thermostat inputs until the expiration of a first time period sufficient to warm up the control board and for flashing the (LED) in accordance with the previously described assigned code prior to the expiration of said first tine period. Preferably, the time period is approximately five minutes; and as herein embodied, the control board time delay of five minutes is energized by means of a 24-volt power supply from the transformer installed in the indoor variable speed air handler 74. As soon as the control board receives power from terminal 74, it warms up for five minutes before it starts operating.

In accordance with the invention, the system also operates to respond to the energizing of the first stage thermostat input 78 for applying the energizing signal to the first compressor output terminal 96 at the expiration of a first time interval of sufficient duration to avoid the effects of intermittent operation of the thermostat contacts and operative to respond to the deenergizing of the first state thermostat input 78 for rendering the first compressor output terminal 96 unresponsive to the subsequent energization of the first stage thermostat input during a second time interval that is preferably five minutes, but may be in the range of two to eight minutes, to avoid short cycling.

The control board of the present invention also operates to respond to the energizing of the second-stage thermostat input during the active operational state of the first compressor for applying the energizing signal to the output terminal of the second compressor at the expiration of the first time period to avoid the effects of intermittent operation of thermostat contacts, and operates to respond to the deenergizing of the second stage thermostat input for rendering the second compressor output terminal unresponsive to the subsequent energization of the second stage thermostat input during a second time interval that is preferably approximately five minutes duration but may be in the range of two to eight minutes.

Figure 3:
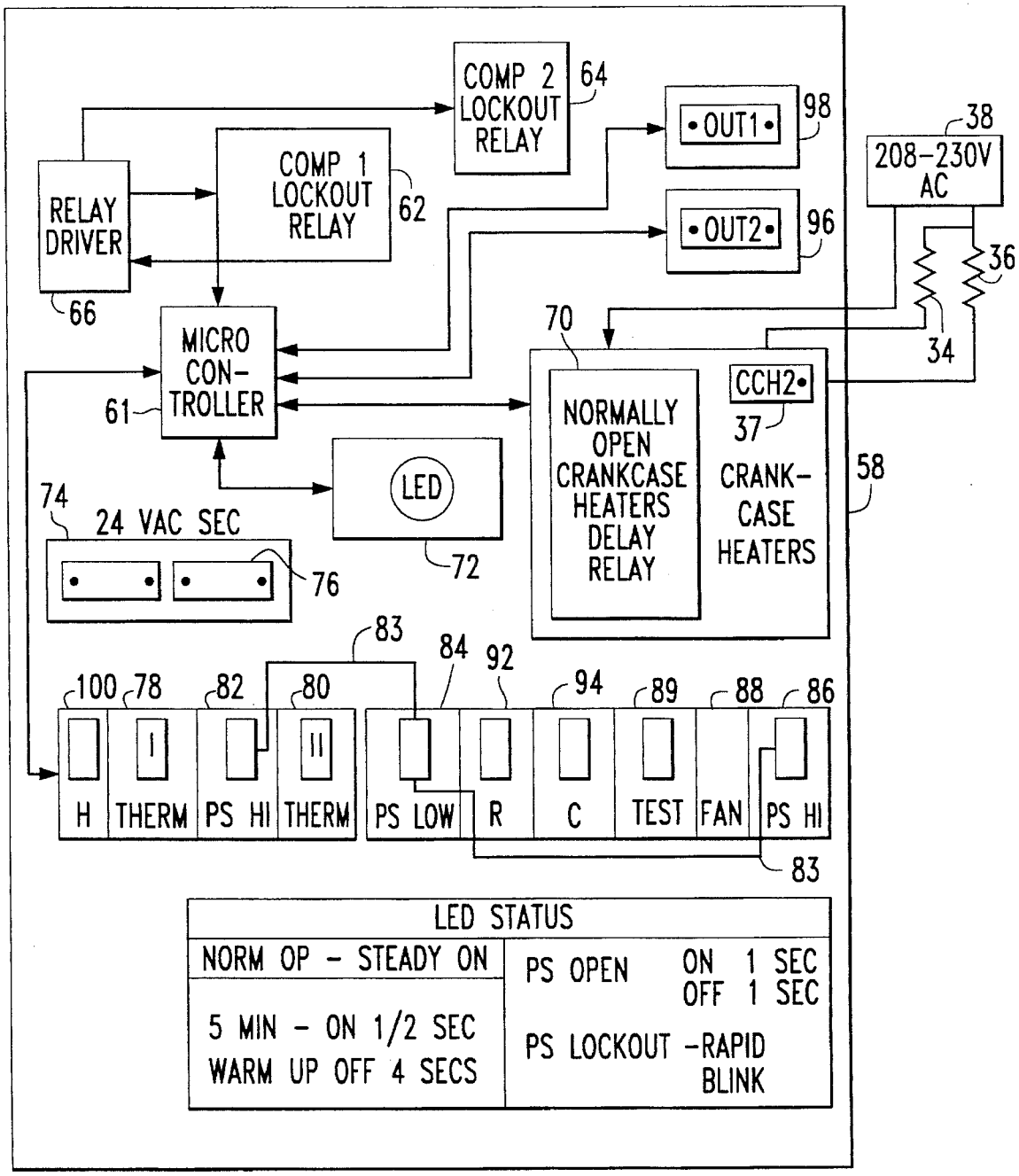
FIG. 3 is a schematic block diagram of the control board of the system and method of the present invention.

In accordance with the invention, the control board is operative to respond to the energizing of the first compressor output terminal 96 for deenergizing both the first and second crankcase heaters 34 and 36. As shown in FIG. 3, the crankcase heaters delay relay 70 is normally open. However, if only one of the compressors is operating both of the crankcase heaters 34 and 36 are deenergized or shut off, this is possible because of the common connection of the suction line of the tandem compressors 10 and 12. It is only when both of the compressors 10 and 12 are deenergized that the crankcase heaters delay relay closes to energize the heaters 34 and 36. However, the crankcase heaters are not energized until after the expiration of a period of time that may range between five and 60 minutes. Preferably, the delay period of 30 minutes is used. Any energizing of the output terminals 96 or 98 during this time will deactivate the crankcase heater delay relay.

The control board of the present invention is operative to respond to the opening of any one of the high- and low-pressure limit switches of the first and second compressors a predetermined plurality of times within a specific time period for disabling both the first and second output compressor terminals 96 and 98 until thermostat is reset or until power to the system is interrupted, and for flashing the lamp in accordance with an assigned code during disablement of the output terminals as previously described. As herein embodied, 24 volts AC from the terminal 74 is supplied by the terminal 84 of the control board. The output of 84 is routed serially through the high- and low-pressure switches of both compressors. After the limit switches, the signal is input to the board at the terminals 82 and 86 at two points. However, if the signal is removed, the output compressor terminals 96 and 98 will be deactivated, a five-minute anti-cycling period will be initiated, and the lamp will flash an error condition. If any of the limit switches are tripped four times during a compressor cycle, the control will go to a lockout condition through the lockout relays 62 and 64.

The apparatus of the present invention is also operative upon the deenergization of the first-stage thermostat input 78 for rendering the output compressor terminals unresponsive to the energizing of the thermostat input terminals for a time period sufficient to prevent short-cycling of the compressor or compressors. As herein embodied, this time delay may be set anywhere from 2 to 8 minutes preferably, this time delay to prevent the system from short-cycling, after a thermostat off cycle or power interruption, is approximately five minutes. There is a five-minute time delay for both the first and the second compressor after a thermostat off cycle. These delays are incorporated to prevent the short-cycling of the unit. However, during the five-minute delay on the second compressor 12, the first compressor 10 and the outdoor fan (not shown) will continue to run, together with the indoor variable speed air handler, if a call for operation still exists.

Any time the unit receives a call for second-stage operation from the thermostat input 80 when the first or lead compressor 10 is operating, there is a one-minute time delay before the second compressor will start. The outdoor fan motor and the first compressor 10 continue to run during this interstage time delay.

In accordance with the invention, the apparatus is operative to respond to the activation of the second compressor output terminal for increasing the speed of the variable speed fan, and means responsive through the detection of humidity in the air in communication with the indoor coil in excess of a selected degree in a range of from 40 to 60 percent for decreasing the speed of the variable speed fan to effect a minimum air flow of not less than 324 cubic feet per minute for each ton capacity of the compressors. As herein embodied, and referring to FIG. 3, a humidistat is fastened to the terminal 100, and, upon the closing of the humidistat switch, the speed of the air fan is slowed considerably in order to permit the moisture to be subtracted from the air surrounding the coil.

Figure 4A:
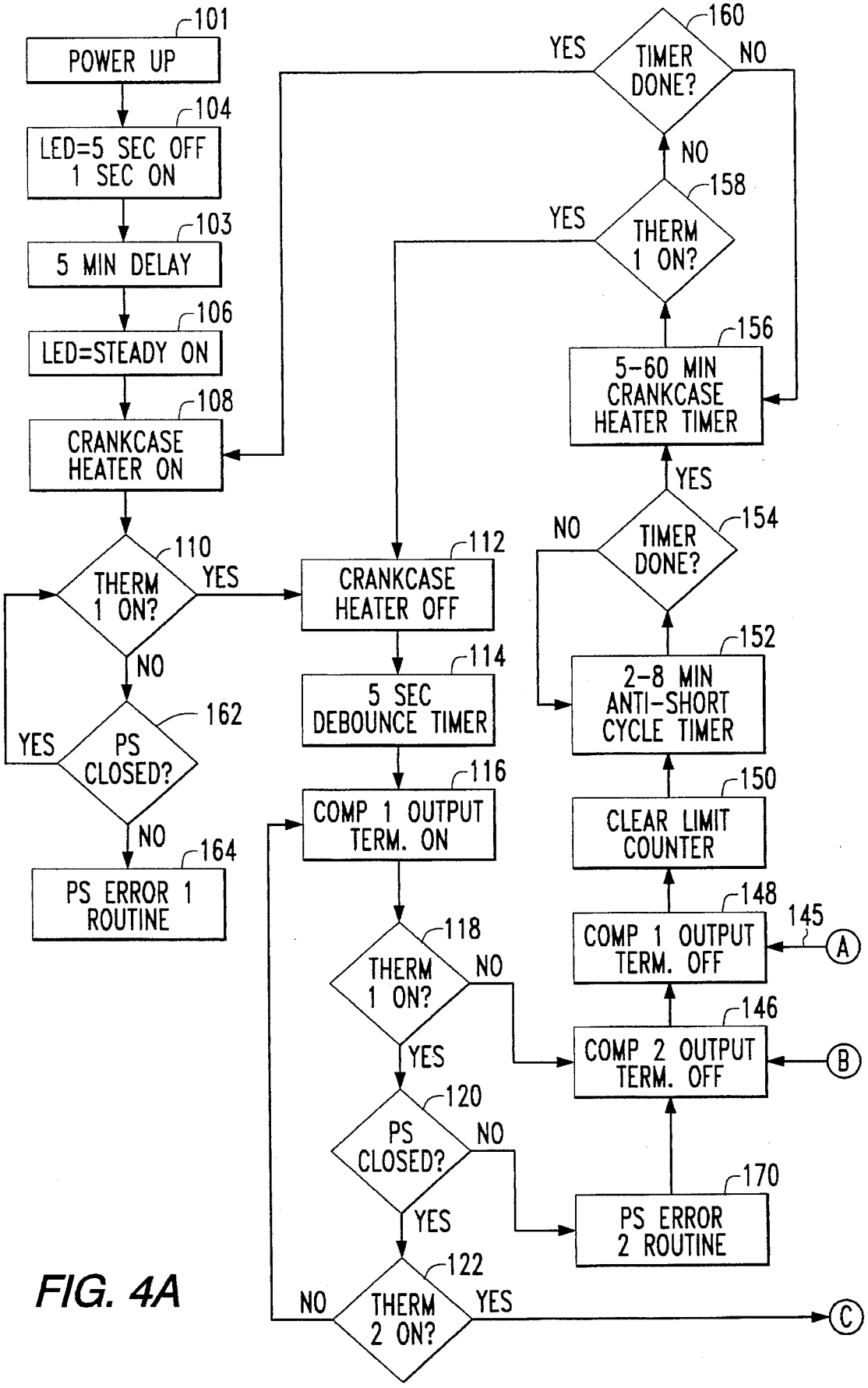
FIGS. 4A, 4B and 4C is a flowchart illustrating the steps in operating the apparatus in accordance with the method of the present invention.
Figure 4B:
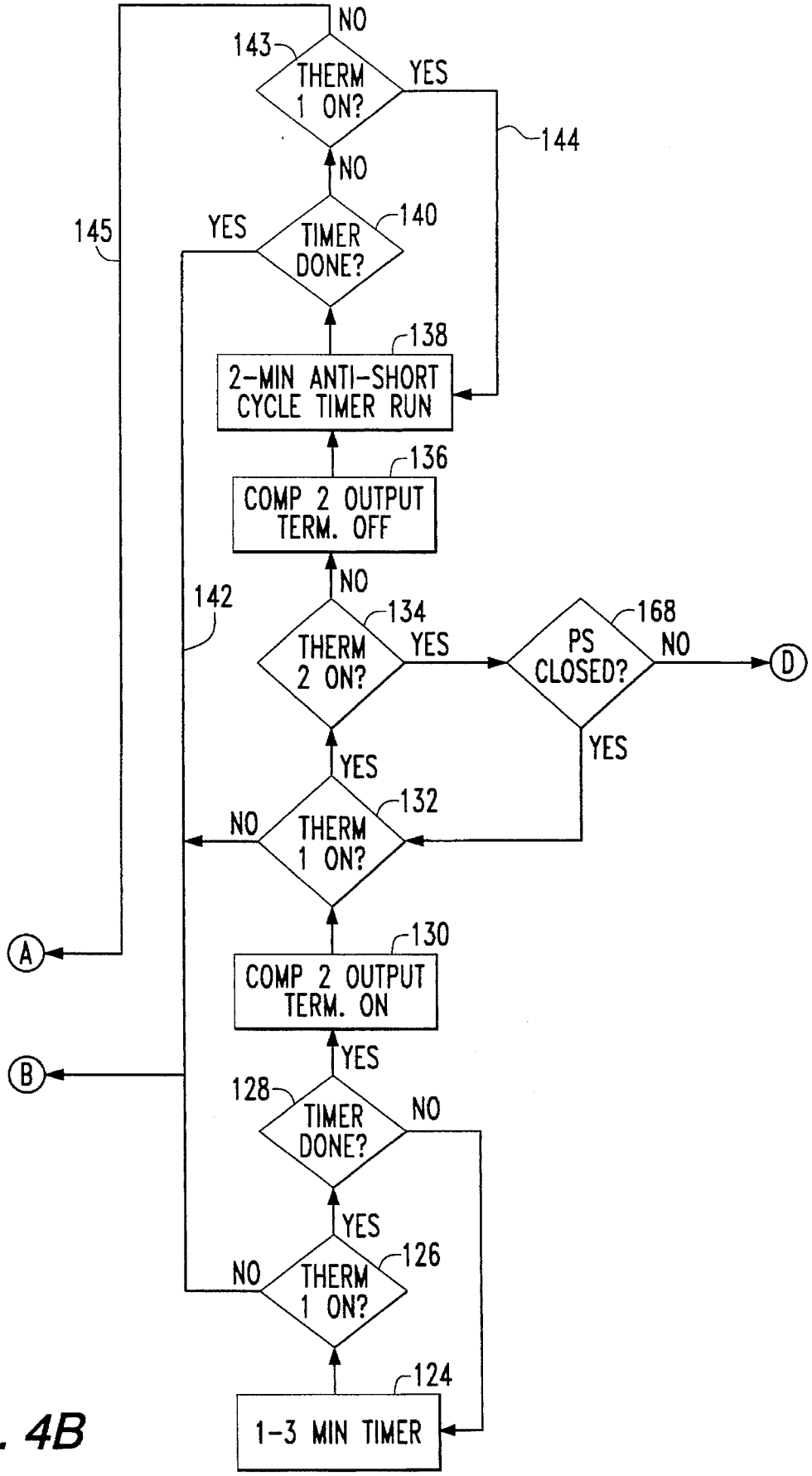
Figure 4C:
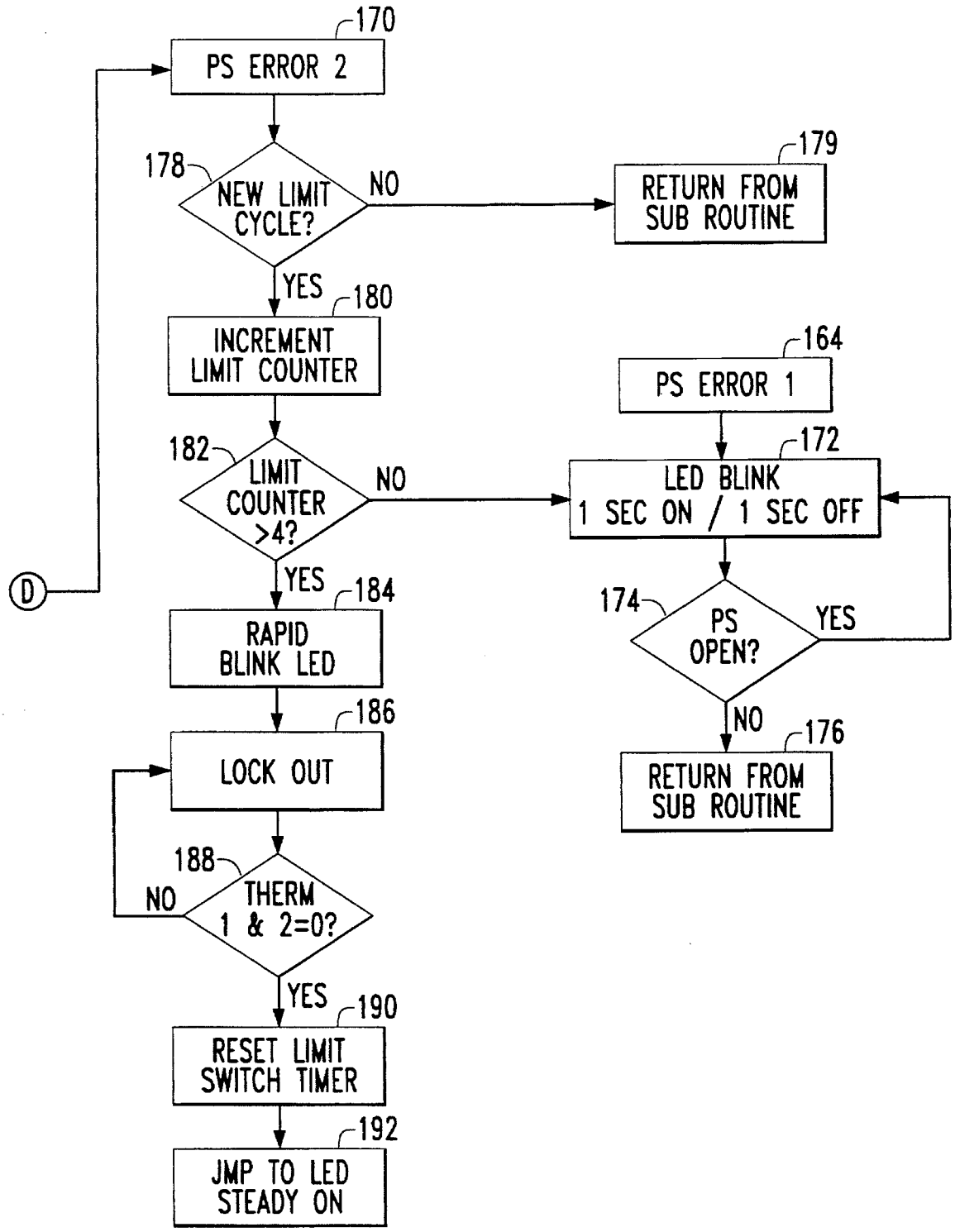

A more detailed description is now given in connection with the operation of the system as set forth in the flow chart of FIGS. 4A, 4B and 4C. As soon as the control board 58 receives power from the source 74 and 76 at step 101, it warms up for five minutes before it starts operating as shown at Step 103 of FIG. 4A. During this time, the LED is flashing in accordance with four-second off and one-half second on code as indicated at Step 104. After the board is warmed up at the expiration of the five-minute delay, the LED then changes to a steady on condition as indicated at Step 106.

At the expiration of the five-minute delay, the system checks to see if the crankcase heater is on at Step 108 and to determine if the first-stage thermostat input is energized at decision block 110. If the first-stage thermostat input is on, then the crankcase heater is turned off at step 112. Upon turning off the crankcase heaters, a delay of five seconds occurs at step 14, to avoid the effects of a debounce or intermittent operation before energizing the output terminal 96 for the first compressor 10 as indicated at block 116. The first or lead compressor 10 is now operating. The system checks to see if the first-stage thermostat terminal 78 is energized at decision block 118. If the terminal 78 is energized and all pressure switches are closed, as determined at decision block 120, the second-stage thermostat terminal 80 is queried at block 122 as to whether it is energized or deenergized. If the second stage input is energized as indicated at block 122, a timer is started as indicated at step 124, (see FIG. 4B) at the expiration of the three minutes as indicated at block 128, and a determination that the first-stage thermostat input 78 is energized at block 126 then the output terminal 80 for the second compressor is turned on at Step 130. The system then checks at decision block 132 to determine if the first-stage thermostat input is energized. If it is energized, then the system checks at block 134 to determine if the second-stage thermostat input is energized. If the second-stage is not energized, then the compressor output terminal 98 for the second compressor is deenergized at Step 136. Upon the deenergizing of the second compressor output 98, an anti-short-cycle timing device at 138 commences to run. This device prevents the compressors 10 and 12 from short-cycling. The compressors must wait for two to eight minutes, depending on the design of the system, before which the compressor two can start again from rest. Decision block 140 determines whether or not the timer 138 has completed its task, and, if so, the system loops back on line 142 to the decision block 126 for determining the status of the first stage thermostat input as previously described. If the timer 138 has not completed, and the first-stage thermostat input is energized as determined at decision block 143, then the system loops back on line 144 to the device 138 to continue cycling until the anti-short cycle period expires. If the thermostat input 78 for the first stage is not energized as indicated at block 143, then the output terminal 96 for the first compressor is deenergized over line 145 at block 148.

In addition, even though decision block 140 indicates that the time period for the timing device 138 has expired, then the second compressor output terminal 98 is maintained deenergized at block 146 at times when the block 126 indicates that the first stage thermostat is deenergized. Following the deenergization of the first compressor output terminal 96, a limit counter 150 is cleared so that any previous occurrences of exceedingly high pressure or insufficient low pressure is eliminated from the system. After clearing the limit counter, the anti-short cycle timer is started at block 152 during which period of time the first and second compressor output terminals 96 and 98 are unresponsive to the energization of the corresponding first and second stage thermostat inputs. After the anti-short cycle timer has completed the timing period as determined at decision block 154, the timer of the crankcase heater delay relay 70 is started at block 156. During the five to sixty minute time period at block 156, the system checks to determine whether or not the first stage input 78 is energized at block 158 and whether or not the time period at 156 has expired. As long as both of these determinations are negative, the timer is permitted to continue to the expiration of the period. In the event that the first stage thermostat input should be on during this period, the crankcase heaters are turned off as indicated at block 112. In the event, that the first stage thermostat input is deenergized at decision block 158 and the time period of block 156 has expired as indicated at decision block 160, then the crankcase heaters are turned on at block 108.

When the first stage thermostat is energized at 110, then the crankcase heater is turned off at block 112. However, if it is not energized, a decision is made at 162 as to whether or not the pressure limit switch is closed. If it is closed, the output of 162 is merely looped back to the decision block 110. However, if it is one of the pressure switches is open and the first stage thermostat input 78 is deenergized, then a first error routine is commenced at block 164.

In the event that the high pressure limit switch is closed as indicated at decision block 168, then the first stage thermostat input 78 is checked at decision block 132 to determine if it is on, and also the second stage thermostat input is checked at 134 to determine if it is on provided that the first stage thermostat input is on, then the routine merely loops with nothing further happening in the system. However, in the event that the second stage thermostat input is deenergized, then the second compressor output terminal is turned off at 136 and the timer is started at 138 as previously described. Also, in the event that the first stage thermostat input 78 is deenergized as determined at decision block 132, then the second compressor output terminal is turned off at block 148. In the event that the pressure limit switch is not closed as determined at decision block 168, then the pressure switch error routine is commenced at block 170. As shown in FIG. 4C, the commencing of the error routine at block 164 causes the LED to blink on and off at one second intervals at block 172. As long as the limit switch is open, as determined at block 174, the LED continues to blink at the previously mentioned rate. When the limit switch closes, the error one subroutine is terminated at 176. When the limit switch is opened and the second compressor output terminal 98 is energized, then the commencing of the error routine at 170 checks to determine whether the thermostat has been manually reset or the power supply has been turned off and restarted at decision block 178. If this is not a new limit cycle, then the subroutine is terminated at 179. If the decision is in the affirmative at block 178, the limit counter is increased by one at block 180. If the limit counter has not yet reached a number greater than four, indicating that a limit switch has not opened five times the LED continues to blink at the rate of one second on and one second off as indicated at 172. However, when the limit switch has opened more than four times as determined at block 182 within the same cycle, then the LED blinks at a rapid rate at block 184. At the same time, the system is locked out at block 186. During a lockout the relays 62 and 64 are operated cutting off power to the compressors 10 and 12 irrespective of the energized state of the inputs 78 and 80 or outputs 96 and 98. Once the system has been locked out, it will not operate by resetting any of the switches alone unless the thermostat is manually reset. This lockout condition will persist until the thermostat is reset as indicated at 188. In the event there is no energy on the first and second stage thermostat inputs 78 and 80, then the increment counter starts counting again from zero at block 190. The affirmative indication at decision block 188. After the resetting of the thermostat, the limit switch timer is reset. Once the timer has been reset, the LED is illuminated steadily with no interruptions at block 192.

In summary, a two stage cooling indoor thermostat (not shown) is used; and depending on the cooling load requirements, the first and second compressors 10 and 12 are energized in sequence by means of the two stage inputs 78 and 80 as previously described. When a call is made for the first stage operation, the outdoor fan (not shown) and the first compressor 10 are energized. Simultaneously, the variable speed indoor fan motor 51 is also energized and the fan delivers the corresponding air flow adequate for the first stage operating load. With a call for second stage operation, the follower or second compressor 12 is also energized. Simultaneously, the variable speed fan 51 now delivers the rated cubic feet per minute in order to satisfy the demand. The second compressor 12 is energized only when the demand is not met by the lead compressor 10 running alone. Once the second stage building load is satisfied, the unit operates with only the first or lead compressor, until the first stage indoor thermostat input is satisfied, or if there is a subsequent call for a second stage operation.

Each time the control board 58 is powered after a power interruption, it will delay response to any inputs for five minutes. In this condition, the LED light on the control board will blink on for one second and off for four seconds indicating a warm-up period for the control board.

The five second time delay is energized each time the board receives a signal energizing the first or second stage thermostat input 78 or 80. This prevents cycling of the unit and the unnecessary operation of the unit as a result of thermostat jiggling.

Any time that the control board receives a call for second stage operation from the thermostat, when the first or lead compressor is operating, there is a one minute to three minute time delay before the second or follower compressor 12 will start. The outdoor fan motor and the first compressor 10 continue to run during this between stage time delay.

There is a five minute time delay for both, the first and the second compressor, after a thermostat OFF cycle. These delays are incorporated to prevent the short cycling of the unit. However, during the five minute delay on the second compressor, the first compressor and the outdoor fan continues to run together with the indoor variable speed fan 51 if the call for operation still exists.

The high and low pressure switches are installed and wired in series, and provide additional protection for the system if any abnormal operating conditions occur. Should the control board sense a tripping of either the high or low pressure switch, the control will provide a five minute delay before the system starts operating again as previously described.

A summary of the various states of the system is now described. During normal operation, when a first state thermostat input 78 is applied to the first compressor 10, a five second debounce period occurs prior to activating the first compressor output terminal 96. This first compressor output is designed to activate a motor contactor that starts the first compressor. After the input is removed, a two to eight minute wait period occurs during which the output terminals 96 and 98 will not respond.

During normal operation, when the second stage thermostat input is applied, the first stage thermostat input must also be on or energized for a response to happen. A one to three minute debounce period occurs prior to activating the second stage compressor output. If the first stage thermostat input is removed, the second compressor output terminal is always deenergized. After the second stage thermostat input is removed, there is a two to eight minute antishort cycle period during which the output terminals 96 and 98 will not respond to inputs.

The crankcase heaters are normally on when there is no call for a compressor. The crankcase heaters for both the first and second compressors turn off when only the first compressor output terminal is energized. When the first compressor turns off, there is a five to 60 minute delay period prior to turning the crankcase heaters on again. This helps in reducing the power consumption during the cycling of the first compressor, thereby improving the efficiency.

A 24 volt AC current is supplied from the terminal 84 of the control board 58. This output is routed through the high and low pressure switches of both the first and second compressors. After the limit switches, the signal is input to the board 51 at the high pressure terminals 82 and 86. These inputs are monitored and should be normally on. If the signal should go low, both the first and second compressor output terminals are deactivated, a five minute anticycle period is initiated, and the LED flashes an error condition.

It will be apparent to those skilled in the art that various modifications and variations can be made in the apparatus and method of the present invention without departing from the period or scope of the invention. For example, with the benefit of the description of the present invention, the apparatus and method could be modified to control either a two state single compressor or a single stage single compressor. For the single stage compressor, it is contemplated that the inputs and outputs relating to the second compressor can be eliminated and still retain certain of the features of the present invention. For the two speed or stage compressor, the controls for the second compressor could be used to control the second stage if the single compressor while still retaining certain features of the present invention. Thus it is intended that the present invention cover the modifications and variations of this invention provided they come within the scope of the appended claims and their equivalents.

What is claimed is:

1. An air conditioning apparatus comprising a first and second motor operated compressor having a common suction line and a common indoor coil;

a control board having a first stage and a second stage thermostat input, said inputs being energized in response to the closing of a respective first and second contact of a thermostat, and having first and second compressor output terminals that are energized selectively to operate the respective first and second compressors;

means responsive to the energization of the first stage thermostat input for energizing the first compressor output terminal;

means responsive to the energization and deenergization of the second stage thermostat input for respectively energizing and deenergizing the second compressor output terminal at times when the first compressor output terminal is energized;

means responsive to the deenergization of the first stage thermostat input at times when the second compressor output terminal is energized for deenergizing both the first and second compressor output terminals.

2. The apparatus of claim 1 further comprising first and second crankcase heaters for corresponding first and second compressors; and wherein the control board includes means responsive to the continuous deactivation of both the first and second compressor output terminals during a time period in the range of from five to sixty minutes for energizing the first and second crankcase heaters at the expiration of said time period at times when the first stage thermostat input is deenergized.

3. The apparatus of claim 1, further comprising a normally closed high pressure limit switch and low pressure limit switch operative to open in response to excessive pressure and/or insufficient pressure in each of the first and second compressors, said high and low pressure limit switches of the compressors being connected in series; and wherein the control board includes a microcontroller having means for counting each time one of the compressors exceeds the high or low pressure limit; and means for deenergizing the first and second compressors in response to a plurality of openings of any one of the high or low pressure limit switches within a specified period of time.

4. The apparatus of claim 1 wherein the control board comprises means responsive to the deenergization of the first compressor for rendering the first compressor output terminal unresponsive to the energization of the first state thermostat input for a time period in the range of from two to eight minutes commencing with the deenergization of the first compressor output terminal.

5. The apparatus of claim 1 wherein the control board comprises means responsive to the energization of the second stage thermostat input for energizing the second compressor output terminal at the expiration of a time period in the range of from approximately one to three minutes commencing with said second stage thermostat input energization.

6. The apparatus of claim 5 wherein the control board comprises means responsive to the deenergization of the second compressor output terminal at times when the first stage thermostat input is energized for rendering the second compressor output terminal unresponsive to the energization of the second stage thermostat input for a time period in the range of from two to eight minutes.

7. The apparatus of claim 1, further comprising indoor air handling elements including a variable speed fan, means for increasing the speed of the fan in response to the energization of the second stage thermostat input, and means responsive to humidity of the indoor air for decreasing the fan speed.

8. A method of operating on air conditioning apparatus having a first and second motor operated compressor with a common suction line and indoor coil and a control board having a first stage and second stage thermostat input terminal, and having first and second compressor output terminal operative when energized to run the respective first and second compressors, the method comprising energizing the first compressor output terminal in response to the energizing of the first stage thermostat input, energizing and deenergizing the second compressor output terminal during the energization of the first compressor output terminal in response to the energization and deenergization of the second stage thermostat input; and deenergization both the first and second compressor output terminals in response to the deenergization of the first stage thermostat input.

9. The method of claim 8 wherein the apparatus further comprises first and second crankcase heaters for corresponding first and second compressors, the method further comprising deenergizing the first and second crankcase heaters in response to the energization of the first stage thermostat input, and energizing the first and second crankcase heaters in response to the deenergization of the first stage thermostat input at the expiration of a time period in the range of from five to sixty minutes following the deenergization of the first stage thermostat input provide the first stage thermostat input is de-energized at the expiration of said time period.

10. The method of claim 8 wherein the first and second compressors each includes a normally closed high pressured and low pressure limit switch operative to open in response to excessive or insufficient pressure in the corresponding compressor, the method comprising connecting the low and high pressure limit switches of both first and second compressors in series;

counting each time one of the high or low pressure switches opens within a prescribed period; and rendering the first and second compressors unresponsive to the first stage and second stage thermostat inputs when the counter reaches a specific count within the prescribed time period.

11. The method of claim 8 comprising rendering the first compressor output unresponsive to the energization of the first stage thermostat input for a time period in the range of from two to eight minutes commencing with the deenergization of the first compressor output terminal.

12. The method of claim 8 comprising rendering the second compressor output terminal unresponsive to the energization of the second stage thermostat input for a period of time in the range of from one to three seconds commencing with the energizing of the second stage thermostat input.

13. The method of claim 12 comprising rendering the second compressor output terminal unresponsive to the energization of the second stage compressor output terminal following the deenergization of the second stage input terminal for a period of time ranging from two to eight minutes.

14. The method of claim 8 wherein the apparatus comprises indoor air handling elements including a variable speed fan, the method comprising operating the fan at a first speed in response to energization of the first compressor output terminals; operating the fan at a second speed faster than the first speed in response to the energization of the second compressor output terminals and means responsive to humidity of the indoor air to decrease the speed of the fan.

15. An air conditioning apparatus comprising a first and second stage compressor having a common suction line and a common indoor coil;

a control board having a first stage and a second stage thermostat input, said inputs being energized in response to the closing of a respective first and second contact of a thermostat, and having at least one compressor output terminal energized selectively to operate the respective first and second stages;

means responsive to the energization of the first stage thermostat input for energizing the at least one compressor output terminal;

means responsive to the energization and deenergization of the second stage thermostat input for respectively energizing and deenergizing the second stage compressor output terminal at times when the at least one compressor output terminal is energized;

means responsive to the deenergization of the first stage thermostat input at times when the at least one compressor output terminal is energized for deenergizing both the first and second stage compressor output terminal.

16. The apparatus of claim 15 further comprising a crankcase heater for the first and second stage compressor; and wherein the control board means responsive to the continuous deactivation of the at least one terminal for both the first and second stage compressor output terminal during a time period in the range of from five to sixty minutes for energizing the crankcase heater at the expiration of said time period at least at times when the first stage thermostat input is de-energized.

17. The apparatus of claim 15 further comprising a normally closed high pressure limit switch and low pressure limit switch operative to open in response to excessive pressure and/or insufficient pressure in the compressor, said high and low pressure limit switch of the compressor being connected in series; and wherein the control board includes a microcontroller having means for counting each time the compressor exceeds the high or low pressure limit; and means for deenergizing the first and second stage of the compressor in response to a plurality of openings of any one of the high or low pressure limit switches within a specified period of time.

* * * * *